United States Patent [19]

Pankoke

[11] 4,384,516

[45] May 24, 1983

[54] APPARATUS FOR APPLYING SURFACE PRESSURE TO ADVANCING WORKPIECES

[76] Inventor: Werner Pankoke, Grosser Kamp 3, 4800 Bielefeld 1, Fed. Rep. of Germany

[21] Appl. No.: 243,648

[22] Filed: Mar. 13, 1981

[30] Foreign Application Priority Data

Mar. 14, 1980 [DE] Fed. Rep. of Germany ..... 3009770
Dec. 23, 1980 [DE] Fed. Rep. of Germany ..... 3048839

[51] Int. Cl.[3] ..... B30B 5/04

[52] U.S. Cl. ..... 100/154; 425/371; 156/583.5

[58] Field of Search ..... 100/118, 151, 152, 153, 100/154, 93 RP, 295; 156/555, 582, 583.1, 583.5; 425/371, 405 R; 162/358; 277/12, DIG. 7, 166, 188

[56] References Cited

U.S. PATENT DOCUMENTS 3,748,225 7/1973 Busker et al. ..... 100/154 X
3,970,515 7/1976 Busker ..... 100/151 X
4,053,276 10/1977 Ahrweiler et al. ..... 100/295
4,285,525 8/1981 Held ..... 100/154 X
4,331,073 5/1982 Girola ..... 100/154

*Primary Examiner*—Peter Feldman
*Attorney, Agent, or Firm*—Spencer & Kaye

[57] ABSTRACT

In an apparatus for applying surface pressure onto advancing workpieces including at least one rotating pressing belt whose interior is acted on by a pressure plate, a plurality of smaller pressure chambers are arranged over the width of the effective pressure area of the pressing belt. Each one of these pressure chambers is divided into an inner pressure chamber and an outer pressure chamber so that the compressed air first builds up in the inner pressure chamber and then, with a delay, in the outer pressure chamber. Moreover, the inner fitting may be provided with a blocking device which temporarily blocks the supply of pressure medium to the outer pressure chamber.

13 Claims, 9 Drawing Figures

APPARATUS FOR APPLYING SURFACE PRESSURE TO ADVANCING WORKPIECES

BACKGROUND OF THE INVENTION

The invention relates to an apparatus for applying surface pressure to advancing workpieces, such as wooden boards, boards made of wood materials or the like, the apparatus including at least one rotating pressing belt which can be pressed by means of a pressure medium against the workpiece in a pressure chamber disposed on the inside of the pressing belt and equipped with a seal.

In connection with such apparatus, it has been known to provide, above or below a workpiece passing on the upper side or on the underside, a single pressure chamber which covers approximately the entire width of the advancing workpiece. Such large pressure chambers, which are charged by a pressure medium such as compressed air, have various drawbacks. The sealing strips oriented in the direction of the pressing belt at the open side of such a pressure chamber are under considerably greater stress in the advancing direction of the workpiece than the seals oriented transversely to the direction of advancement of the workpiece. This leads to differences in abrasion and premature wear and also to losses of air. Due to the great length of the sealing strips, such a seal cannot be made of one piece. There exist one or a plurality of junctures which also lead to leaks or pressure losses. Great forces originating from the pressure medium act on the sealing strip so that they must be supported which is possible only at considerable structural expense. If there is a sudden great loss of pressure, the workpiece presses the pressing belt against the inner surfaces of the pressure chambers. This produces considerable water unless these inner surfaces are coated with a special antifriction material. The measures, taken merely to realize emergency running properties, are complicated and difficult to accomplish.

SUMMARY OF THE INVENTION

It is an object of the invention to improve the general apparatus in such a manner that the seals are formed without junctures or grooves and without the need for expensive supports and that they have good emergency running properties. The sealing strips should be easily exchanged. Moreover, the pressure chamber should be easily adaptable to workpieces having different widths.

Additionally, the advancing workpiece itself should directly control the pressure medium flowing into the many outer pressure chambers and thus control the movement of the many internal fittings which from time to time contact the pressing belt, on the one hand, independently of one another and, on the other hand, independently of the desired shape (width, length) as well as the passage rate of the individual workpieces.

This is accomplished according to the present invention in an apparatus of the above species in that a plurality of smaller pressure chambers are arranged over the width of the effective pressure surface of the pressing belt, the basic shape of such pressure chambers being that of round bodies having a circular base face.

With a plurality of such small pressure chambers, the sealing problem can be solved to particular advantage. Pressure chambers which have a basically circular shape, i.e. constitute cylindrical sections, can be produced very advantageously. The circular sealing strips can be manufactured of one piece, i.e. without joints.

Due to its advantageous configuration, the seal is well supported at all sides and premature wear is avoided. Since the annular faces are relatively small, they can be worked with great precision. Difficulties due to processing inaccuracies as they occurred with prior art seals are eliminated. Small sealing strips can also be exchanged with ease. By simple juxtaposition of additional, smaller pressure chambers, the total effective pressure surface area on the pressing belt can be broadened or extended depending on the desired size of the pressing surface. The same components can always be resorted to. It is further possible to combine the small pressure chambers in rows which are situated next to one another in the direction of advancement of the pressing belt and are each charged separately (in rows) with a pressure medium. Thus it is possible with simple means to produce different pressures over the width of the pressure surface (pressing area) and to produce a different effective useful width of the pressing surface.

In a preferred embodiment there is provided a blocking device between the two pressure chambers for temporarily interrupting the pressure medium supply from the inner pressure chamber to the outer pressure chamber.

Such a blocking device makes it possible that when a workpiece arrives and thus the pressing belt is raised over a corresponding surface together with one or a plurality of inner fittings of individual pressure chambers the associated blocking device opens and pressure medium flows not only steadily into the inner pressure chamber but additionally also temporarily into the outer pressure chamber so that in the area of this outer pressure chamber the pressing belt is also pressed against the workpiece by the pressure medium. Such a control of each individual outer pressure chamber lying in the region of the surface of the passing workpiece has an immediate effect (i.e. without delay) and can cover all pressure chambers.

Once the workpiece has passed through, this blocking device, together with the movement of the inner fitting in the direction toward the pressing belt, blocks the supply of pressure medium to the outer pressure chamber so that the latter is essentially without pressure and no pressure medium can disadvantageously escape to the sides.

It does not matter in this connection what type of outline the passing workpiece has and whether a plurality of smaller workpieces with different outlines pass through simultaneously. The pressure chambers lying in the area of the surfaces of these workpieces are continuously charged with or relieved of pressure medium, as described above, so that the pressing belt is pressed on only in the region of the advancing surface of the workpiece or workpieces. Pressure losses are substantially avoided by such a direct and locally defined control.

In this embodiment according to the invention, the charge on the outer pressure chamber changes corresponding to the respective (temporarily) effective width of the pressure surface (corresponding to the width of the passing workpiece).

In a preferred embodiment, this blocking device is given the shape of an O sealing ring which is disposed between the annular chamber provided between the inner variable position fitting and the stationary holding member, and a step in the holding member.

In a modified embodiment according to the invention, the holding member is provided with further transverse bores so that the stationary holding member controls the flow of pressure medium, in the manner of a control piston, in dependence on the variable position of the inner fitting of each pressure device.

It is to be understood that both the foregoing general description and the following detailed description are exemplary and are not intended to be restrictive of the invention.

DETAILED DESCRIPTION OF THE PREFERRED EMBODIMENTS

The apparatus according to the invention comprises a lower frame and an upper frame, each accommodating endless pressing belts 10. These pressing belts are tensioned over guide rollers and can be driven thereby. They are arranged to leave a gap between them of a width which corresponds to the width of the workpiece to be processed. While the pressing belts 10 perform a horizontal movement with their surfaces contacting the workpiece, the workpiece is pulled into the gap between these surfaces and is there charged with pressure by the surfaces of the pressing belts 10. During passage of the workpiece through this device, the former is thus worked so that it leaves the gap between the pressing belts 10 at the exit as a finished workpiece.

In this way, foils which are unwound from supply reels can be pressed onto the upper and underside of the workpiece. Such a pressing process can take place at room temperature, or the application of high temperatures to the workpiece in the processing region may be provided at the same time. The desired pressure may be applied as air pressure acting in the pressure chambers which are disposed at the rear side of the pressing belt 10 with respect to the workpiece, i.e. at the surface of the pressing belt 10 which is not in contact with the workpiece.

Figure 3:
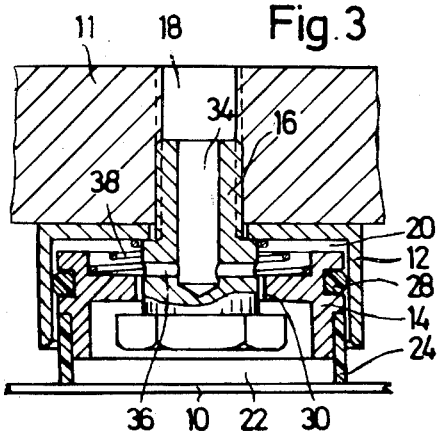
FIG. 3 is an enlarged view of the pressure chamber shown in partial section in FIG. 2.
Figure 4:
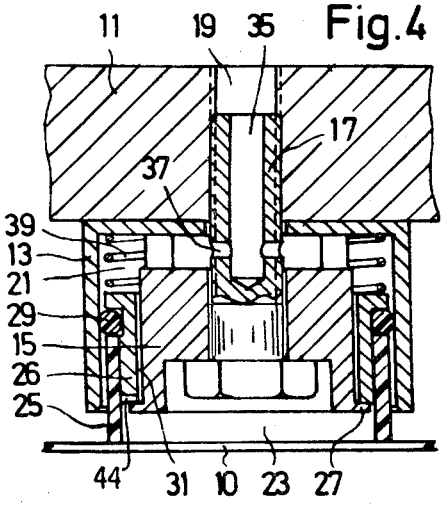
FIG. 4 is a partial sectional view of a pressure chamber of modified design.

The pressure chambers are disposed at a common pressure plate 11. Referring to FIGS. 3 and 4, for example each pressure chamber is formed by an inner fitting 14 or 15, respectively. The outer fitting 12 or 13 is held at the pressure plate 11 by means of a screw member 16 or 17, respectively, which is screwed into a threaded bore 18 or 19 in the pressure plate 11. Each pressure chamber is divided by the inner fitting 14 or 15, respectively, into an inner pressure chamber 20 or 21 and an outer pressure chamber 22 or 23.

The outer fitting 12 or 13 and the inner fitting 14 or 15 are arranged to be concentric with one another. An annular seal 24 or 25 held by the inner fitting 14 or 15 rests on the pressing belt 10. According to FIGS. 3, 6, 7 and 9 of the drawing, the seal 24 is inserted into a recess in the inner fitting 14. According to FIG. 4 of the drawing, the seal 25 is fastened to a guide ring 26 which concentrically surrounds the inner fitting 15. The guide ring 26 is supported at a flange 27 formed at the inner fitting 15. An elastic sealing ring 28 or 29, respectively, bridges the space between the inner fitting 14 (FIG. 3) or between the guide ring 26 (FIG. 4) and the outer fitting 12 or 13 surrounding it. In FIG. 3 the inner fitting 14 with the seal 24 is thus able to move slightly without friction with respect to the outer fitting 12. In FIG. 4 the guide ring 26 with its seal 25 is also able to move slightly, without friction, with respect to the outer fitting 13.

Figure 1:
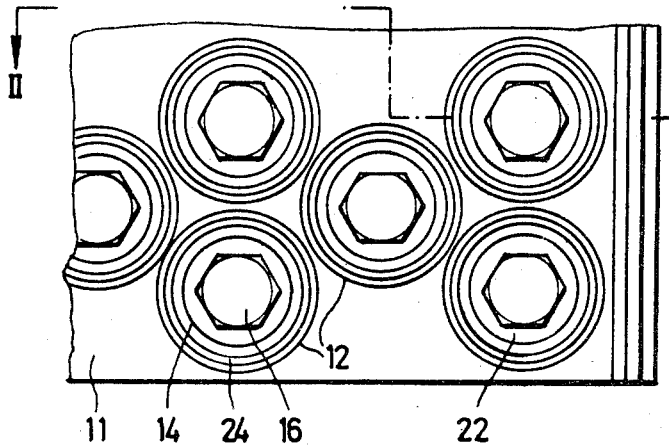
FIG. 1 is a bottom view of a plurality of cylindrical pressure chambers disposed at a pressure plate in accordance with the present invention.
Figure 2:
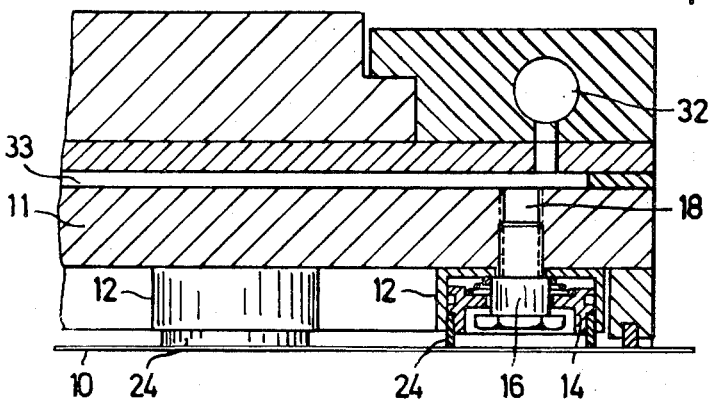
FIG. 2 is a vertical partial sectional view along line II—II of FIG. 1.
Figure 5:
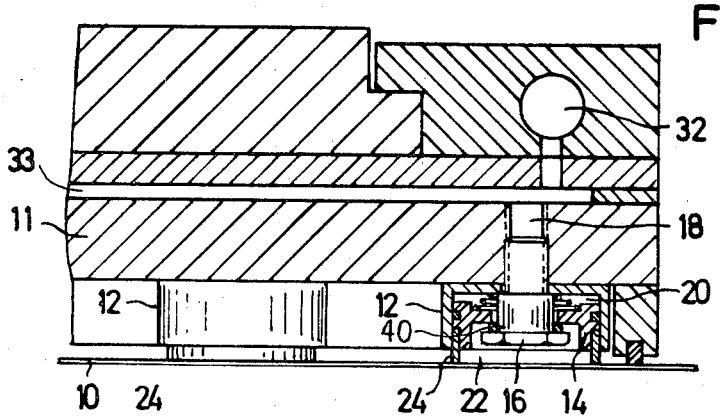
FIG. 5 is a vertical partial sectional view of a modified, cylindrical pressure chamber.
Figure 6:
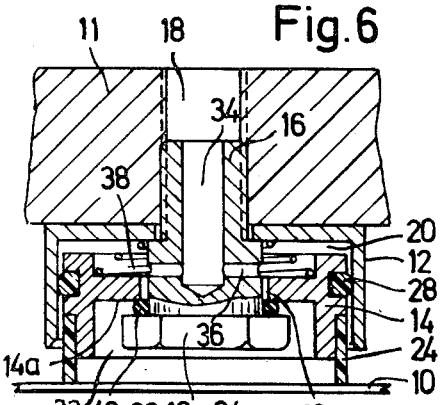
FIG. 6 is a vertical partial sectional view of the same pressure chamber with a blocking device according to FIG. 5 in the relaxed position.
Figure 7:
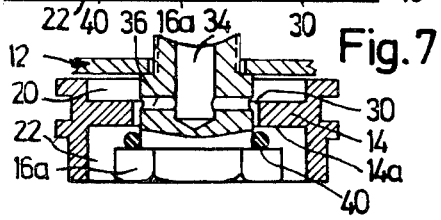
FIG. 7 is a vertical partial sectional view of the same pressure chamber with the blocking device in the charged position.

According to FIGS. 3, 6 and 7, of the drawing, an annular chamber 30 which connects the inner pressure chamber 20 with the outer pressure chamber 22 is provided between the screw member 16 having a stepped head **16*a* and the inner fitting 14. According to FIG. 4 of the drawing, an annular chamber 31 and slot 44 are provided between the inner fitting 15 and the guide ring 26 so as to connect together the inner pressure chamber 21 and the outer pressure chamber 23. Referring to FIGS. 2 and 5, compressed air can flow through channels 32 and 33 to the threaded bores 18 or 19 shown for example in FIGS. 3 and 4, respectively, in the pressure plate 11 and from there through a central blind bore 34 in the screw member 16 or through a central blind bore 35 in the screw member 17 through radial bores 36 of the screw member 16 or through radial bores 37 of the screw member 17 into the inner pressure chamber 20 or 21, respectively. From there, the compressed air can flow, via the annular chamber 20 or 21, respectively, into the outer pressure chamber 22 or 23, respectively, and there presses the pressing belt 10** against the workpiece.

According to FIGS. 3, 7, 8 and 9 of the drawing, the pressure in the inner pressure chamber 20 builds up in advance of the pressure in outer pressure chamber 22 and causes the inner fitting 14 together with the seal 24 to be pressed against the pressing belt 10. The pressing force depends on the pressure and on the surface of the inner fitting 14 which is charged with pressure inside the pressure chamber 20 and which is parallel to the pressing belt 10. This force is counteracted by a force depending on the pressure in the outer pressure chamber 22 and the surface of the inner fitting 14 charged by this pressure. The pressure in the outer pressure chamber 22 causes the pressing belt 10 to be pressed against the workpiece.

If, during operation, compressed air escapes from the outer pressure chamber 22 through a gap between the seal 24 and the pressing belt 10, such compressed air can be replenished with a certain choke effect from the inner pressure chamber 20 through the annular chamber 30. The air pressure in the outer pressure chamber 22 is then somewhat less than the pressure in the inner pressure chamber 20. If, now an undesirable escape of compressed air out of the outer pressure chamber 22 occurs during operation, the choke effect of the annular chamber 30 causes an increase in the pressure difference between the inner pressure chamber 20 and the outer pressure chamber 22 so that the force resulting from the pressure forces of the inner pressure chamber 20 and of the outer pressure chamber 22 pressing the inner fitting 14 with its seal 24 perpendicularly onto the pressing belt 10 becomes greater.

Correspondingly, in FIG. 4 of the drawing, the pressure in the inner pressure chamber 21 causes the guide ring 26 together with the seal 25 to be pressed against the pressing belt 10. The contact pressure depends on the pressure and on the frontal face of the guide ring 26 parallel to the pressing belt 10 inside the inner pressure chamber 21. This force is counteracted by a force which depends on the pressure in the outer pressure chamber 23 and on the frontal face of the guide ring 26 charged with this pressure within the outer pressure chamber 23. The pressure in the outer pressure chamber 23 causes the pressing belt 10 to be pressed against the workpiece.

If, during operation, compressed air escapes out of the outer pressure chamber 23 through a gap between the seal 25 and the pressing belt 10, the compressed air from the inner pressure chamber 21 can flow through the annular chamber 31 with a certain choke effect. The air pressure-in the outer pressure chamber 23 is then somewhat less than the pressure in the inner pressure chamber 21. If thus during operation there occurs an undesirable escape of compressed air from the outer pressure chamber 23, the pressure difference between the inner pressure chamber 21 and the outer pressure chamber 23 increases due to the choke effect of the annular chamber 31 so that the force resulting from the pressure forces of these chambers, which presses the guide ring 26 and the seal 25 perpendicularly onto the pressing belt 10, becomes greater.

In order to make the force with which the inner fitting 14 or the guide ring 26, respectively, is pressed toward the pressing belt greater than the force with which this fitting or this guide ring, respectively, is pressed away from the pressing belt 10, a helical compression spring 38 or 39, respectively, is inserted into the inner pressure chamber 20 or 21, respectively, the one end of this spring being supported at the outer fitting 12 or 13 and the other end at the inner fitting 14 or at the guide ring 26. According to FIGS. 3, 6, and 8 of the drawing, this helical compression spring 38 is given a conical shape while the helical compression spring 39 according to FIG. 4 of the drawing is cylindrical.

Since, however, the choke effect performed by the annular chamber 30 is often insufficient and pressure medium escapes undesirably, an additional blocking device in the form of an O-shaped, preferably elastic sealing ring 40 is inserted, according to the invention, between the stepped head **16*a* and the pressing belt side face 14*a* of the inner fitting 14 (see FIGS. 6 and 7). This sealing ring locks the annular chamber 30 when the pressing belt side face 14*a* approaches the stepped head 16*a* so that the pressure effect from the inner pressure chamber 20 on the inner fitting 14** is increased.

Such a simple blocking device permits the supply of pressure medium from the inner chamber 20 into the outer chamber 22 to be controlled directly by means of the passing workpiece and particularly its outer contours.

If a workpiece enters, its edges press against the pressing belt 10 and raise it over a surface area which corresponds to the surface of the passing workpiece. Thus all inner fittings 14 of the small pressure devices (pressure chambers) lying in the region of the edges and of the surface of the passing workpiece are raised so that the distance between the pressing belt side face **14*a* and the stepped, fixed head 16*a* is increased and thus the annular chamber 30 between the inner and outer chambers 20, 22 opens (FIG. 7). This causes the pressure medium which now flows into the outer pressure chamber 22 to press the pressing belt 10 against the passing workpiece. After passage, the rear edges of the workpiece release the inner fitting 14 so that the latter is lowered and the annular chamber 30 is again closed by the sealing ring 40. The outer pressure chamber 22 becomes free of pressure and thus also the pressing belt 10 which is not pressed into the free area (without workpiece). Then, pressure medium can also not escape in a disadvantageous manner (FIG. 6**).

Figure 8:
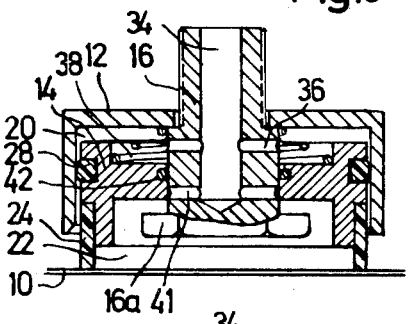
FIG. 8 is a vertical partial sectional view of the same pressure chamber with a further modified blocking device in the relaxed position.
Figure 9:
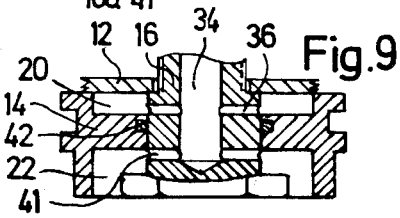
FIG. 9 is a vertical partial sectional view of the same pressure chamber with the blocking device in the charged position.

In a modified embodiment shown in FIGS. 8 and 9, the holding member (screw member) 16 is provided, in addition to the bores 36 for supplying pressure medium into the inner pressure chamber 20, with further bores 41 which open and close depending on the height setting of the inner fitting 14 whose position is directly controlled by the passing workpiece.

If a workpiece enters, its edge causes the inner fitting 14 (FIG. 9) to be raised and to release the lower bores 41, so that pressure medium can also flow into the outer pressure chamber 22 and there, as in the embodiment according to FIG. 7, it presses the pressing belt against the advancing workpiece. With the passage of the rear edge of the workpiece, the inner fitting 14 moves down and thus closes the bores 41 (FIG. 8). To do this, the inner fitting 14 may enclose the holding member 16 in a snug fit. If a small gap between the outer wall of the holding member 16 and the inner fitting 14 cannot be eliminated in practice, it is advisable and preferable to insert a sealing ring 42 into this gap in order to thus prevent inadvertent influx of pressure medium from the inner chamber 20 into the outer chamber 22.

A further advantage of the invention is found in the design of the screw member 16, 17 whose bores 34, 35 are designed as blind bores from which the radial bores 36, 37 open into the inner pressure chamber 20, 21. This causes compressed air to intially build up in the inner pressure chamber 20, 21 and move the inner fitting 14, 15 with seal 24, 25 onto the pressing belt 10 to seal the outer pressure chamber 22, 23. Only after passing the annular chamber 30, 31, will compressed air build up, with a delay, in the already sealed outer pressure chamber 22, 23.

I claim:

1. An apparatus for applying surface pressure on an advancing workpiece comprising:

at least one rotatably mounted pressing belt having one side disposed for applying pressure to the workpiece;

a common pressure plate; and a plurality of pressure chambers each delimiting a pressure region connected to receive a pressure medium and each being provided with a sealing means for sealing each said pressure chamber with respect to said pressing belt, said pressure chambers being disposed on the side of said belt facing away from the workpiece and being arranged substantially over the width of said belt to be used to apply pressure to the workpiece, each said pressure chamber having a cylindrical shape with a circular base facing said belt and including an outer fitting;

a concentric holding member for fastening said outer fitting to said common pressure plate, said holding member being provided with a central blind bore the opening of which faces said common pressure plate and with at least one radial bore which connects said central bore with said pressure region;

a concentric inner fitting disposed within said outer fitting and movable in a direction perpendicular to said pressing belt, said inner and outer fittings being arranged to define a space therebetween and being disposed in a manner to divide said pressure region into an inner partial region adjacent said pressure plate and an outer partial region bordering said pressing belt, said inner partial region and said outer partial region being connected together by an annular passage between said inner fitting and said holding member; and a first sealing ring disposed to bridge said space.

2. An apparatus according to claim 1 wherein said first sealing ring comprises a rubber elastic ring.

3. An apparatus according to claim 1 wherein each said concentric holding member comprises a screw and said common pressure plate is provided with threaded bores for receiving said screws.

4. Apparatus according to claim 1 further comprising a blocking device provided between said inner and outer partial regions so as to temporarily interrupt the supply of pressure medium from said inner partial region to said outer partial region in response to movement of said inner fitting.

5. An apparatus according to claim 4 wherein said inner fitting is provided with a surface facing said pressing belt, said holding member is provided with a stepped head, and said blocking device comprises an O-ring which is inserted between said inner fitting surface facing said pressing belt and said stepped head.

6. Apparatus according to claim 1 wherein said holding member is provided in the form of a screw whose head projects into said outer partial region.

7. An apparatus for applying surface pressure on an advancing workpiece comprising:

at least one rotatably mounted pressing belt having one side disposed for applying pressure to the workpiece;

a common pressure plate; and a plurality of pressure chambers each delimiting a pressure region connected to receive a pressure medium and each being provided with a sealing means for sealing each said pressure chamber with respect to said pressing belt, said pressure chambers being disposed on the side of said belt facing away from the workpiece and being arranged substantially over the width of said belt to be used to apply pressure to the workpiece, and each said pressure chamber having a cylindrical shape with a circular base facing said belt and including an outer fitting;

a concentric holding member for fastening said outer fitting to said common pressure plate, said holding member being provided with a central blind bore the opening of which faces said common pressure plate, at least one radial bore which connects said central bore with said pressure region, a stepped head and at least one transverse bore between said at least one radial bore and said stepped head;

a concentric inner fitting disposed within said outer fitting and movable in a direction perpendicular to said pressing belt, said inner and outer fittings being arranged to define a space therebetween, said inner fitting having a center bore with an annular wall through which said holding member passes, the distance between said transverse and radial bores being larger than the thickness of said annular wall of said center bore; and a first sealing ring disposed to bridge said space.

8. An apparatus for applying surface pressure on an advancing workpiece comprising:

at least one rotatably mounted pressing belt having one side disposed for applying pressure to the workpiece;

a common pressure plate; and a plurality of pressure chambers each delimiting a pressure region connected to receive a pressure medium and each being provided with a sealing means for sealing each said pressure chamber with respect to said pressing belt, said pressure chambers being disposed on the side of said belt facing away from the workpiece and being arranged substantially over the width of said belt to be used to apply pressure to the workpiece, each said pressure chamber having a cylindrical shape with a circular base facing said belt and including an outer fitting;

a concentric holding member for fastening said outer fitting to said common pressure plate, said holding member being provided with a central blind bore the opening of which faces said common pressure plate and with at least one radial bore which connects said central bore with said pressure region;

a concentric inner fitting disposed within said outer fitting and movable in a direction perpendicular to said pressing belt, said inner and outer fittings being arranged to define a space therebetween;

a first sealing ring disposed to bridge said space; and a second sealing ring disposed between said holding member and said inner fitting.

9. An apparatus according to claim 8 wherein said second sealing ring comprises an O-ring.

10. An apparatus according to claim 1 wherein said sealing means is fastened to said inner fitting and is movable therewith.

11. An apparatus for applying surface pressure on an advancing workpiece comprising:

at least one rotatably mounted pressing belt having one side disposed for applying pressure to the workpiece;

a common pressure plate; and a plurality of pressure chambers each delimiting a pressure region connected to receive a pressure medium and each being provided with a sealing means for sealing each said pressure chamber with respect to said pressing belt, said pressure chambers being disposed on the side of said belt facing away from the workpiece and being arranged substantially over the width of said belt to be used to apply pressure to the workpiece, each said pressure chamber having a cylindrical shape with a circular base facing said belt and including an outer fitting fastened to said common pressure plate;

a concentric inner fitting disposed within said outer fitting and movable in a direction perpendicular to said pressing belt, said inner and outer fittings being arranged to define a space therebetween;

a first sealing ring disposed to bridge said space; and a guide ring disposed between said outer fitting and said inner fitting and movable with said inner fitting, and wherein said sealing means is fastened to said guide ring and is movable therewith.

12. An apparatus according to claim 11 wherein said inner and outer fittings are disposed to divide said pressure region into an inner partial region adjacent said pressure plate and an outer partial region bordering said pressing belt, and said inner partial region and said outer partial region are in communication via an annular passage between said inner fitting and said guide ring.

13. An apparatus for applying surface pressure on an advancing workpiece comprising:

at least one rotatably mounted pressing belt having one side disposed for applying pressure to the workpiece;

a common pressure plate; and a plurality of pressure chambers each delimiting a pressure region connected to receive a pressure medium and each being provided with a sealing means for sealing each said pressure chamber with respect to said pressing belt, said pressure chambers being disposed on the side of said belt facing away from the workpiece and being arranged substantially over the width of said belt to be used to apply pressure to the workpiece, each said pressure chamber having a cylindrical shape with a circular base facing said belt and including an outer fitting fastened to said common pressure plate;

a concentric inner fitting disposed within said outer fitting and movable in a direction perpendicular to said pressing belt, said inner and outer fittings being arranged to define a space therebetween;

a first sealing ring disposed to bridge said space; and a helical compression spring disposed between said inner fitting and said outer fitting.

* * * * *